US005530319A

United States Patent [19]

Adam et al.

[11] Patent Number: 5,530,319

[45] Date of Patent: Jun. 25, 1996

[54] POWER SUPPLY CIRCUIT FOR A DISCHARGE LAMP AND USE OF AND METHOD OF OPERATING THE SAME

[75] Inventors: Volker Adam, Hanau; Walter Dieudonné , Hoesbach; Helmut Gellweiler, Siefersheim, all of Germany

[73] Assignee: Heraeus Noblelight GmbH, Hanau, Germany

[21] Appl. No.: 361,518

[22] Filed: Dec. 22, 1994

[30] Foreign Application Priority Data

Aug. 3, 1994 [DE] Germany ..... 44 07 674.6

[51] Int. Cl.[6] ..... H05B 39/04

[52] U.S. Cl. ..... 315/106; 315/107; 315/94; 315/224; 315/306; 315/308; 315/DIG. 7

[58] Field of Search ..... 315/241 S, 241 P, 315/103, 105, 106, 107, 289, 290, 94, 49, 72, 224, 115, 116, 241 R, 306, 307, 308, DIG. 7

[56] References Cited

U.S. PATENT DOCUMENTS

| | | | |
|---|---|---|---|
| 3,904,925 | 9/1975 | Korzekwa et al. | 315/171 |
| 4,221,994 | 9/1980 | Friedman et al. | 315/224 |
| 4,417,180 | 11/1983 | Chamran et al. | 315/175 |
| 4,438,370 | 3/1984 | Allington | 315/106 |
| 4,742,276 | 5/1988 | Ku | 315/106 |
| 5,047,689 | 9/1991 | Kawai et al. | 315/94 |
| 5,150,009 | 9/1992 | Kling et al. | 315/107 |

FOREIGN PATENT DOCUMENTS

| | | |
|---|---|---|
| 3108547 | 7/1982 | Germany . |
| 1489350 | 4/1989 | Germany . |
| 3908553 | 4/1990 | Germany . |

*Primary Examiner*—Robert Pascal
*Assistant Examiner*—Haissa Philogene
*Attorney, Agent, or Firm*—Oblon, Spivak, McClelland, Maier & Neustadt

[57] ABSTRACT

For triggering a discharge lamp powered by a d.c. source and having electrodes disposed in the lamp bulb, a power supply circuit is proposed having a triggering device where, after the start of heating of a cathode (which cathode is in the form of a heated cathode), the triggering device switches a triggering pulse to a discharge path of the lamp, which discharge path is formed by the two electrodes, and initiates a triggering phase, such that the triggering pulse at least partly overlaps in time with the heating phase of the cathode. In this way, reliable triggering of deuterium discharge lamps and hydrogen discharge lamps is possible, particularly in the case of a deuterium lamp having a relatively small opening, e.g. on the order of 0.3 mm.

10 Claims, 2 Drawing Sheets

POWER SUPPLY CIRCUIT FOR A DISCHARGE LAMP AND USE OF AND METHOD OF OPERATING THE SAME

BACKGROUND OF THE INVENTION

1. Field of the Invention

This invention relates to a power supply circuit for a discharge lamp, having a current limiter and a triggering device, wherein the triggering device is connected in parallel with the discharge path of the lamp formed by the lamp electrodes and has a controllable semiconductor-based electronic switch; and the invention further relates to the use of such a circuit, and a method of operating a discharge lamp.

2. Description of the Prior Art

German Patent No. 3,108,547 discloses a triggering circuit for a high pressure metal vapor discharge lamp wherein the triggering impulse is transmitted to the electrodes of the discharge path of the lamp via a pulse transformer with the aid of a symmetrically connected four-layer diode or a suitably controlled triac; in practice, such switching arrangements are usable only for triggering a.c.-powered discharge lamps and are unsuitable for d.c.-powered discharge lamps such as deuterium lamps and hydrogen lamps.

German Patent No. 3,908,553 discloses a gas discharge lamp filled with deuteriumor hydrogen gas, and methods of triggering gas discharge lamps. Alternative triggering methods described there include:

A) Triggering by applying a high voltage of, e.g., 350 V, between the anode and cathode;

B) Triggering by applying a high voltage in the range of 250 V between the anode and cathode, wherein the anode and lamp housing are interconnected via a high ohmic resistance. As long as no current flows, the anode and housing are at the same potential, so that the arc length upon triggering is shortened and thereby the breakdown voltage is reduced;

C) The triggering of the lamp is initiated by a triggering pulse applied to the lamp housing which is electrically isolated in operation, wherein an electrical arc-over is achieved between the cathode and housing with production of charge carriers which result in an arc between the anode and cathode; this method reduces the necessary triggering voltage to 100 V.

Further, German Patent No. 1,489,350 describes a gas discharge lamp filled with deuterium or hydrogen gas, which provides a device for carrying out the method described at (B), supra. This patent also discloses triggering methods for heating a bimetallic strip which in the cold state rests against and makes electrical contact with the anode and with a housing surrounding the anode, wherewith with the passage of current said strip lifts away from said housing by means of pre-ionization and glow discharge, whereupon the gas discharge lamp is triggered. Such gas discharge lamps present problems due to the relatively high heating of the gaseous contents of the bulb, wherein even with the use of relatively small openings, e.g., with diameters less than 0.5 mm, the triggering of deuterium lamps is made very difficult, and retriggering of a previously triggered gas discharge lamp is even more difficult.

SUMMARY OF THE INVENTION

An object of the present invention is to provide means for triggering a discharge lamp, particularly a hydrogen and/or deuterium discharge lamp, having a heatable electrode, which trigger means is of high reliability and has low heat evolution after the start of the heating phase. Such means should enable triggering of a hydrogen and/or deuterium discharge lamp with opening diameter less than 0.5 mm, with high reliability, and re-triggering of a previously heated deuterium and/or hydrogen lamp with high reliability.

The present invention further encompasses the use of the described power supply circuit, and a method of operating a discharge lamp.

The present invention enables exact timewise adaptation of the triggering, such that by exact timewise definition of the phase of overlap of the heating and triggering phases, a high-precision triggering process is enabled even for deuterium lamps with an opening in the range of 0.3–05 mm or smaller. Further advantages are that the lamp can be retriggered with high reliability even when in a hot state, and even in the case of deviations within prescribed manufacturing tolerances.

It has further been found to be advantageous that the present invention enables pre-setting of the parameters of the heating and triggering phases by digital control employing a microprocessor, wherein the timewise course of said phases is determinable by a query of a permanent memory such that economical and reliable subsystems for ensuring the exact timewise course of said phases may be provided.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
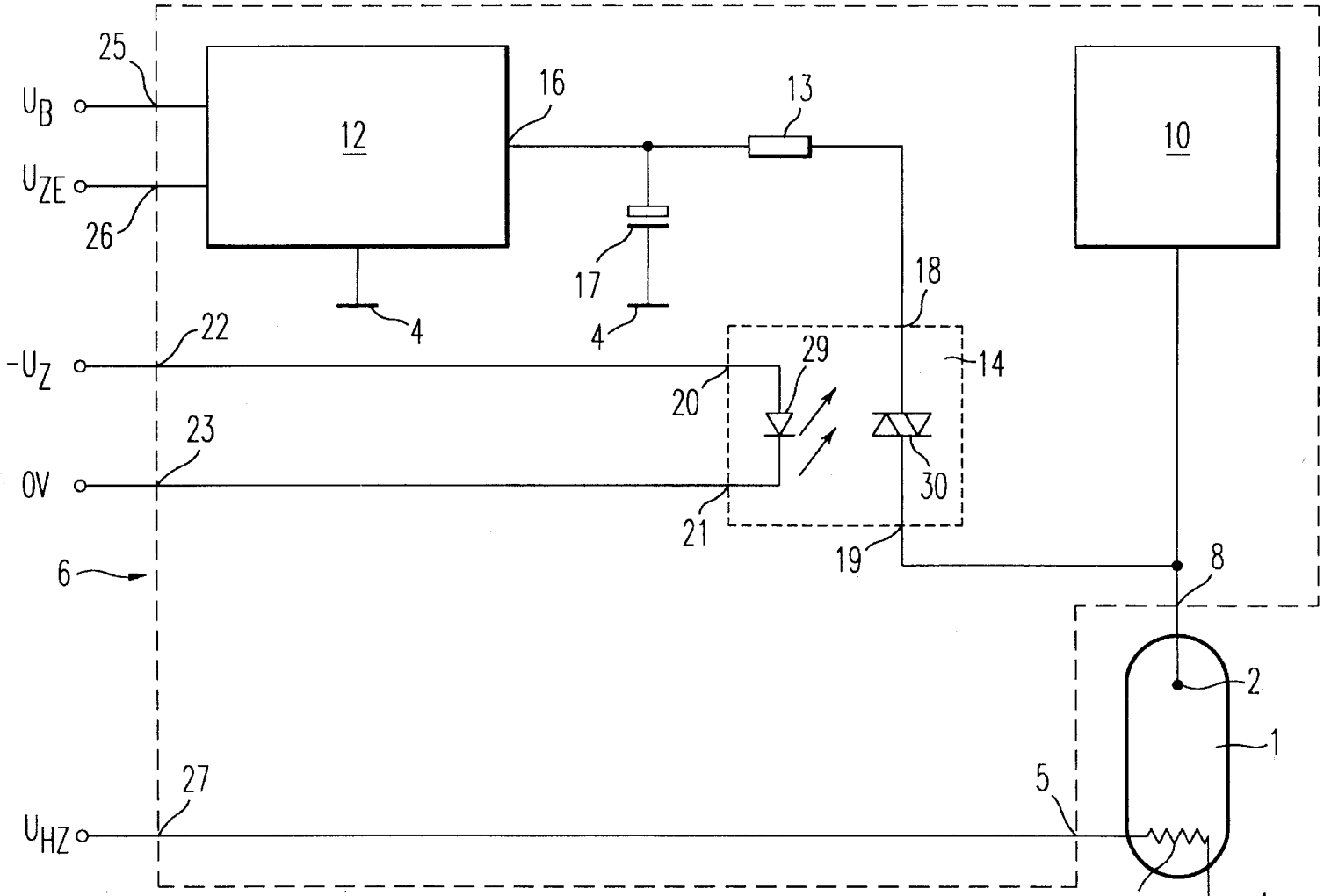
FIG. 1 is a diagram of a power supply circuit for a deuterium lamp.

Referring now to the drawings, wherein like reference numerals designate identical or corresponding parts throughout the several views, and more particularly to FIG. 1 thereof, the deuterium lamp 1 has two electrodes (2, 3) (shown schematically) in its lamp bulb, with electrode 2 serving as the anode, and electrode 3 being in the form of a hot (thermionic) electrode, serving as the cathode. One end of the coil of the cathode 3 is connected to ground 4 and the other end is connected, via connection 5, to the power supply circuit 6. Electrode 2 serving as the anode is connected to the power supply circuit 6 via connection 8. The structure of the lamp illustrated is shown only schematically; for better understanding of the structure of such a lamp, reference is made to the above-cited German Patent No. 3,908,553.

The power supply circuit 6 is comprised of a constant-current source in the form of a d.c. source 10, a circuit branch comprising a triggering-voltage generator 12, a pre-resistor 13, and an electronic switch 14, connected in series with each other successively, wherein said circuit branch is connected in series with the discharge path of lamp 1, which path is formed by the electrodes 2 and 3. A capacitor 17 is connected in parallel with the output 16 of the triggering-voltage generator 12, between said output 16 and the pre-resistor 13, wherein one electrode plate of capacitor 17 is at ground potential 4, i.e. at the potential of the cathode 3.

The electronic switch 14 is in the form of an opto-triac, wherein the (switched) circuit path between terminals 18 and 19 is controlled with the aid of a control signal passed via the control connections (20, 21) to the control input of the electronic switch 14. The control signal is transmitted optically within the switch 14, via a photodiode 29, to the four-layer diode disposed within the radiation range, wherein the transmission is by the optical coupler principle. In this manner, potential-isolation is provided between the control signal and the switch impulse. The switch 14 is controlled via the terminals 22 and 23 of the power supply circuit 6. The triggering-voltage generator 12 is powered via terminal 25, and the on-off signal for generator 12 is supplied via terminal 26. The heating coil of electrode 3 is powered by an external, controllable power supply unit, via terminal 27 of the power supply circuit 6.

The operation of the switching device according to FIG. 1 will be described in more detail with the aid of the time diagram illustrated to FIG. 2.

Figures 2A, 2B, 2C, 2D:
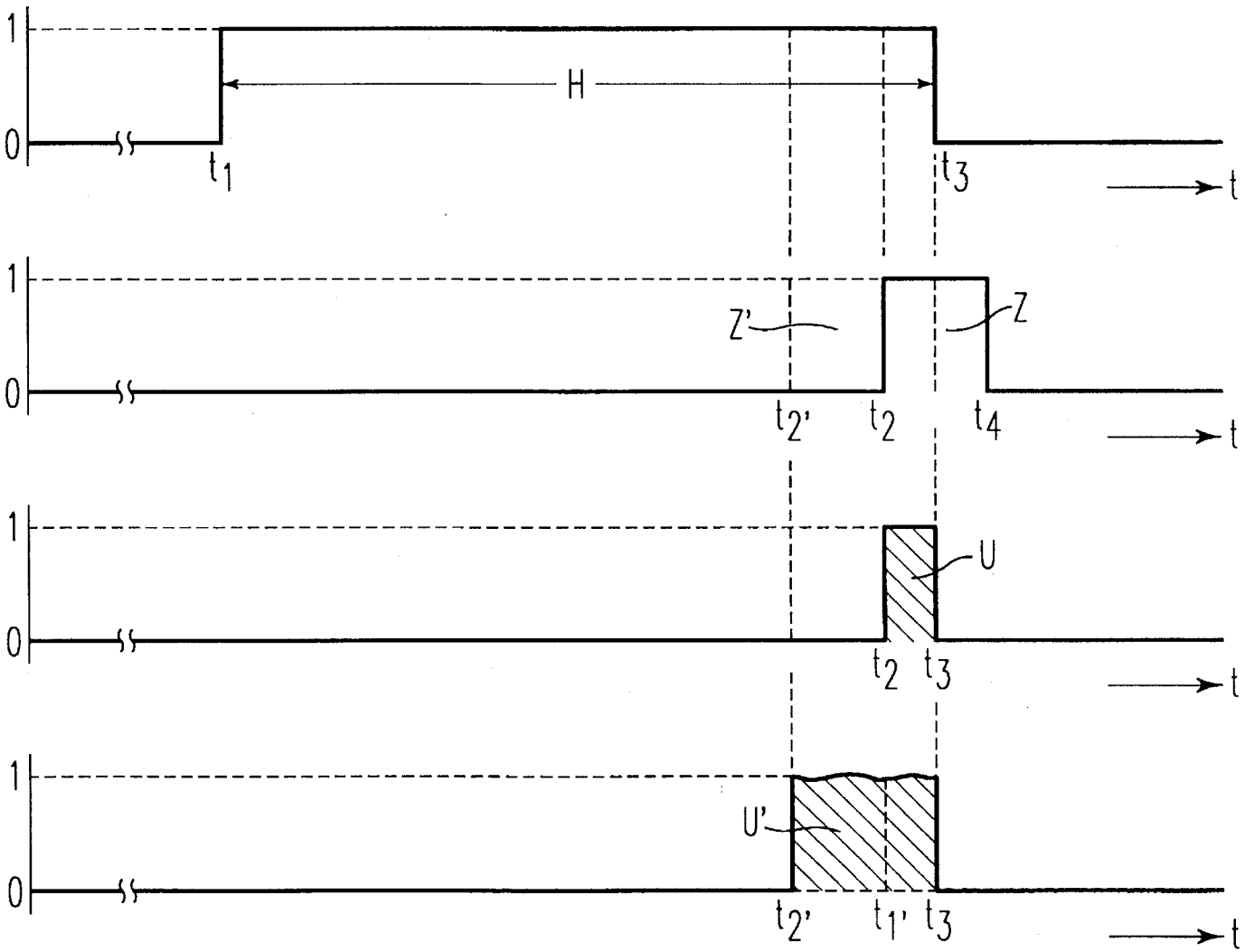
FIG. 2 is a time diagram of the heating and triggering phases of the deuterium lamp.

In FIG. 2 the abscissa of the plots is the time t. According to FIG. 2, timeline A represents the timewise behavior of the electrode-heating via terminal 27 according to FIG. 1 (designated "heating phase H"), timeline B represents the control pulse via terminals (22, 23) according to FIG. 1 (designated "triggering phase Z"), and timeline C represents the time-overlap of the heating phase H (A) and the triggering phase Z (B) (designated the "overlapping phase U"). For purposes of example, a wider overlapping pulse U' is shown in timeline D, resulting from the triggering phase Z' beginning at time $t_2$, (dashed line configuration in timeline B). The end point of the two triggering phases Z and Z' is at time $t_4$.

According to timeline A and FIG. 1, the heating phase H begins by actuating the external power supply unit and the heating current provided via terminal 27 for pre-heating the electrode 3. After passage of the prescribed pre-heating time, according to timeline B at time $t_2$ a triggering phase Z is initiated by actuating the switch 14 in the form of an opto-triac, via the control inputs (20, 21) and the terminals (22, 23), wherein the control means of the triac 30 are irradiated by the optical impulse from photodiode 29, to accomplish optical coupling, so that the circuit path between terminals 18 and 19 of switch 14 is closed and the capacitor 17 charged by the triggering-voltage generator 12 discharges over the pre-resistor 13, the closed switch path (18, 19) of the switch, and the electrodes (2, 3), to the ground 4. The triggering phase Z is shown schematically as a rectangular pulse in timeline B; the actual course of the pulse will be determined by the time constant of the capacitor 17 and resistor 13. The time plot of the actual overlapping phase of triggering phase Z and heating phase H is seen in timeline C, wherein the overlapping pulse U begins at time $t_2$ and has duration equal to the time which the heating phase H and triggering phase Z have in common (note that both have been assigned the nominal value 1); when one of the impulses designated as the heating phase and the triggering phase has fallen off, the overlapping pulse according to timeline C is again set at zero, wherein the effective triggering process ends at the end of heating phase H, e.g. here at time $t_3$, even though the triggering phase Z extends later to time $t_4$.

It has been found advantageous, although by no means limiting, that the time period of overlap of the heating and triggering phases be equal to at least 5–50% of the duration of the triggering phase, or in the range of 500 μsec. to 100 msec. Likewise, it has been found advantageous that the amplitude of the triggering voltage be in the range of 200–1000 volts.

Depending on the specific embodiment of the capacitor and pre-resistor, and depending on the time of actuation, it is possible to begin the triggering phase Z' according to timeline B earlier, so that the actual overlapping phase according to timeline D begins earlier, at time $t_2$, and also ends at the end of the heating phase H at time $t_3$ according to timeline A.

It has been found to be particularly advantageous if a digital computer and memory system are employed to pre-program the timewise course of the heating phase H and triggering phase Z, with optimal sequencing of these two phases; under this arrangement the values of the time points $t_1$, $t_2$, $t_3$, and $t_4$ are provided in advance in a fixed memory, and the actuations for these are performed in sequence by the operation of a microprocessor, via inputs 27, 26, 22, and 23.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A power supply circuit for a discharge lamp, comprising:

a d..c. voltage source connected to a first electrode of said discharge lamp;

a triggering device connected in parallel with said first electrode of said discharge lamp, said triggering device including a triggering-voltage generator, a resistor, and an electronic switch connected in series;

a capacitor connected in parallel between an output of said triggering-voltage generator and one end of said resistor; and control means for controlling said electronic switch so as to regulate a powers supply to said discharge lamp.

2. A power supply circuit according to claim 1, wherein said electronic switch is an opto-triac.

3. A power supply circuit according to any of claims 1–2, wherein said control means is connected to a triggering-impulse generator.

4. A power supply circuit according to claim 3, wherein said d.c. voltage source is a constant-current source.

5. A power supply circuit according to claim 4, further comprising an input terminal to which a voltage is applied which generates a heater current in a second electrode of said discharge lamp.

6. A power supply circuit according to claim 5, wherein said discharge lamp is a deuterium lamp or a hydrogen lamp.

7. A method of operating a discharge lamp, comprising the steps of:

(a) initiating a heating phase by pre-heating a second electrode of said discharge lamp by generating a heating current therein;

(b) initiating a triggering phase a predetermined amount of time after initiation of said heating phase by supplying a triggering voltage to a first electrode of said discharge lamp;

(c) terminating said heating phase; and (d) terminating said triggering phase such that there exists a period of time during which said heating phase and said triggering phase are in effect.

8. A method of operating a discharge lamp according to claim 7, wherein said period of time during which said heating phase and said triggering phase are in effect is equal to at least 5 to 50% of a duration of said triggering phase.

9. A method of operating a discharge lamp according to claim 8, wherein a duration of said period of time during which said heating phase and said triggering phase are in effect is in the range of 500 μsec. to 100 msec.

10. A method of operating a discharge lamp according to any of claims 7–9, wherein an-amplitude of said triggering voltage is in the range of 200–1000 volts.

* * * * *